United States Patent [19]

Van Scoyk et al.

[11] 4,348,854

[45] Sep. 14, 1982

[54] TIEDOWN AND INSTEP STRAPS FOR SPURS

[76] Inventors: Pershing R. Van Scoyk, 7193 W. 32nd Ave., Wheatridge, Colo. 80033; Charles L. Welton, Rte. 1, Box 505 V, Golden, Colo. 80401

[21] Appl. No.: 255,232

[22] Filed: Apr. 17, 1981

[51] Int. Cl.[3] ..... A43C 17/00

[52] U.S. Cl. ..... 54/83 R

[58] Field of Search ..... 54/83 R, 83 A; 36/1, 36/1.5, 58.6, 80, 132, 136

[56] References Cited

U.S. PATENT DOCUMENTS

| | | | |
|---|---|---|---|
| 702,476 | 6/1902 | Price | 36/136 A |
| 1,078,109 | 11/1913 | Reynolds | 36/58.6 |
| 1,155,506 | 10/1915 | Osaki | 36/136 X |
| 1,882,059 | 10/1932 | Boos | 54/83 A |
| 2,484,898 | 10/1949 | MacDonald | 54/83 R X |
| 3,953,958 | 5/1976 | Beaston | 54/83 A |
| 4,045,890 | 9/1977 | D'Alessandro et al. | 36/132 |

*Primary Examiner*—Gene Mancene
*Assistant Examiner*—Robert P. Swiatek
*Attorney, Agent, or Firm*—Horace B. Van Valkenburgh

[57] ABSTRACT

The tiedown strap is formed of neoprene or other suitable resilient material and has a rear extension having a slot for detachably engaging the rowel, a front loop stretchable onto the front of the boot heel and side extensions having holes for detachably engaging a button on the corresponding side of the spur. The instep strap is formed of similar material and has an enlargement at each end for detachable engagement with the spur buttons. When the instep strap and tiedown strap are used together, the side buttons of the spur may be pivotal between upper and lower positions.

11 Claims, 6 Drawing Figures

TIEDOWN AND INSTEP STRAPS FOR SPURS

This invention relates to tiedown straps for spurs, as well as instep straps for use with such tiedown straps.

BACKGROUND OF THE INVENTION

There have been previous attempts to provide straps or other devices for spurs which would prevent the rowel of the spur from falling down or riding up at the rear of the boot. Davis U.S. Pat. No. 71,462 of 1867 discloses a spur having a rowel at the rear and a pair of buttons at each side of the front of the spur, with a lower strap passing under the sole of the boot attached to the front buttons at each side and an upper strap passing over the instep and attached to the front buttons to provide an upward pull, using the lower strap as a fulcrum. However, this construction does not prevent the rear of the spur from riding up on the boot. Boos U.S. Pat. No. 1,882,059 discloses a spur having a button at the rear and a generally triangular portion at the front, at each side, providing a lower bar and an inclined front bar. Each end of a lower strap is attached by a fixed loop to the corresponding lower bar and extends under the sole of the boot, while each end of an upper strap is attached by a fixed loop to the respective front bar at each side, with a buckle connection interposed between the ends of the upper strap. The spur is also provided with a slot adjacent the lower end of the front bar, at each side, to permit a strap loop to be slipped through for assembly. Smith U.S. Pat. No. 2,432,102 discloses a spur holder for a spur attached at the front merely to an ankle strap but the shank of which extends through an upper plate which is screwed to a lower plate, whose lower end is connected to a U-shaped spring wire which extends forwardly along the groove above the heel of the boot. None of the above constructions are satisfactory for holding a spur on a boot and preventing it from becoming dislodged or to move upwardly or downwardly on the heel.

Among the objects of this invention are to provide a tiedown strap for spurs which will hold the spur against movement at the rear, either up or down; to provide such a tiedown strap which exerts a downward pull not only on the front of the spur, against an instep strap, but also a forward pull on the shank to press the spur more firmly against the boot; to provide such a tiedown strap which is readily attachable to and detachable from the spur but is not inclined to become loose; to provide an instep strap which is particularly adapted to cooperate with the tiedown strap of this invention and is also readily attachable to and detachable from the spur; and to provide such straps which are readily manufactured and effective in use.

SUMMARY OF THE INVENTION

In accordance with this invention, a spur tiedown strap is formed of flexible material having resistance to fatigue stress, such as being molded of neoprene, such as having the trade designation MIL-R No. 3065 SC 515, and having a body extending to each side, with a rear extension having a slot, which extension is stretchable so that the slot may be moved over the rowel to engage the rear shank of the spur. The body also has a front loop which is stretchable to engage the front of the heel of the boot and a stretchable extension at each side having a hole to engage a button or the like on each forwardly extending arm of the spur. The slot of the rear extension provides one form of detachable connection to the rear of the spur, while the side extensions provide one form of means detachably connectable to the respective arms of the spur. An instep strap of this invention may comprise a stretchable bar having means at each end for detachable connection to each arm of the spur, one form of such means being a hole in a stretchable extension at each end of the bar. When the above instep strap is used with the tiedown strap, each spur button may be pivotal between an upper position and a lower position.

THE DRAWINGS

DESCRIPTION OF PREFERRED EMBODIMENT

Figure 1:
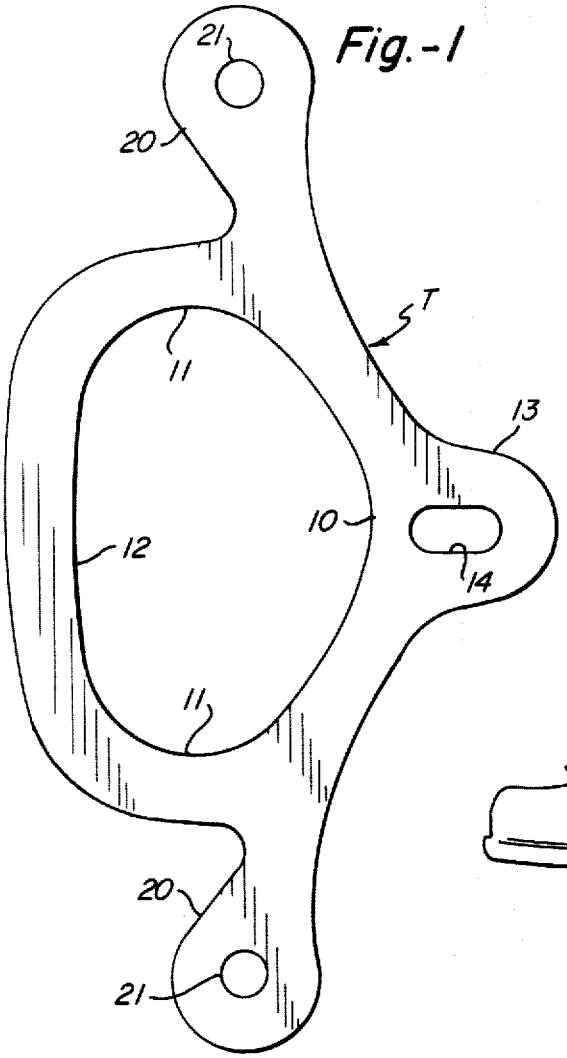
FIG. 1 is a top plan view of a spur tiedown of this invention.
Figure 2:
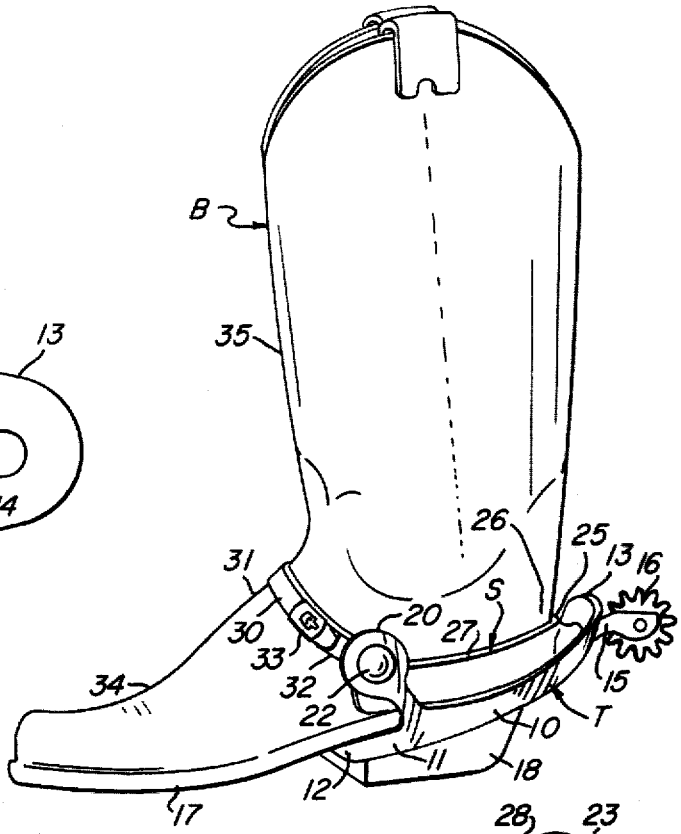
FIG. 2 is a perspective view, on a reduced scale, of the spur tiedown of FIG. 1 installed on a spur and a boot.

As illustrated in FIGS. 1 and 2, a flexible tiedown strap T of this invention may include a curved body 10 extending to arcuate sides 11, integral with a front loop 12 which is slightly convex on the inside, with the inside of body 10, sides 11 and loop 12 providing a generally egg-shaped aperture, as shown. The tiedown strap T is formed of a tough but resilient material which can be stretched but will exert a reasonably strong pull. The material for the tiedown strap should also have a very high resistance to fatigue stress, since it may be stretched and pulled, then permitted to retract, perhaps thousands of times during a useful life. A suitable material comprises molded neoprene, such as having the trade designation MIL-R 3065 SC 515, with a tensile stength of approximately 15,000 pounds per square inch.

Body 10 is provided with an integral rear extension 13 having a slot 14 which engages a shank 15 of a spur S. Extension 13 is stretched sufficiently, for installation, for slot 14 to pass over the outer diameter of a rowel 16, rotatably mounted on the shank in a conventional manner. Spur S is normally positioned to extend along the boot B just above sole 17, while loop 12 and sides 13, after engagement of shank 15 by slot 14, are stretched under heel 18 of the boot and bar 12 then engaged with front of heel 18, just under sole 17.

Figure 3:
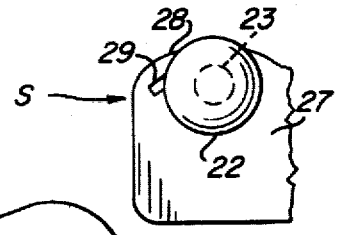
FIG. 3 is a fragmentary side elevation, on an enlarged scale, of the front portion of an arm of the spur of FIG. 2.

Tiedown strap T is also provided with an ear 20 extending from each side and provided with a hole 21, with ear 20 being stretchable so that hole 21 may be pulled over a button 22 of spur S, to engage a stem 23 of the button, shown in dotted lines in FIG. 3. Spur S further includes a band 25 which engages the counter heel 26 of the boot and from which shank 15 extends rearwardly and often upwardly, as in FIG. 4. From band 25, arms 27 extend forwardly at each side, past pin 23, which may be attached by riveting to a boss 28 of the respective arm 27, while a slot 29 may also be provided in boss 28. The spur is normally maintained on the boot by a spur strap 30 attached, as by a sewn loop, to slot 29 of the spur arm 27 on the opposite side of the boot instep 31, on which the strap rests. On the near side, a strap end 32 is similarly attached to slot 29 of FIG. 3 and is adjustably attached to strap 30 by a buckle 33, which is conventionally attached to strap end 32. The relative position of strap 30 and strap end 32 may be opposite for the right boot B, since the left boot is shown in FIG. 2. The boot may also include a foot 34 and an upper portion 35.

The normal attachment of a spur to a boot is accomplished by a spur strap corresponding to strap 30, strap end 32 and buckle 33. This may be sufficient for more genteel riding, but is insufficient for vigorous riding, as in saddle or bare back bronc riding or bull riding in rodeos, in breaking horses, or in calf or steer roping, either in a rodeo or on the range. Thus, the resilience of the loop 12 of tiedown strap T pulls the front end of the spur S down on the boot, while extension 13 prevents shank 15 and rowel 16 from riding up or down at the rear. In the embodiment of FIG. 2, spur strap 30 and strap end 32 provides resistance to the downward pull of loop 12, so that the spur is held securely in position. Although the tiedown strap T is readily installed, as shown in FIG. 2, it is still necessary to unbuckle strap 30 to remove the spur from the boot.

Figure 6:
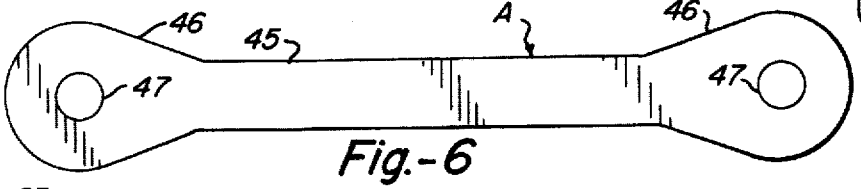
FIG. 6 is a top plan view of an alternative spur strap.
Figure 5:
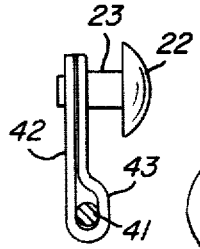
FIG. 5 is a fragmentary, oblique section taken along line 5—5 of FIG. 4.
Figure 4:
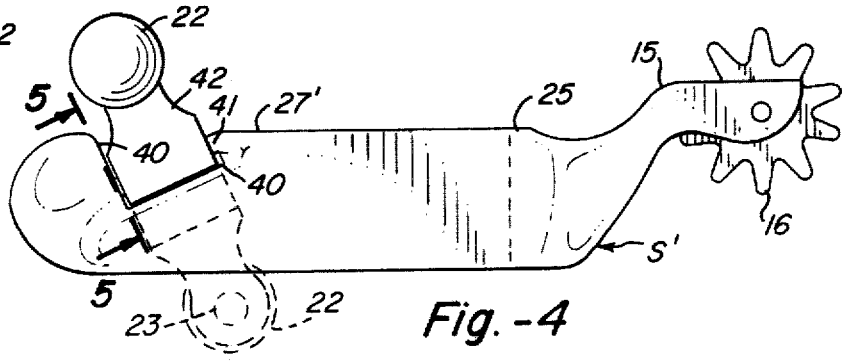
FIG. 4 is a side elevation, on an enlarged scale, of an alternative spur.

In further accordance with this invention, an alternative spur S' of FIGS. 4 and 5 may be utilized with an alternative spur strap A of FIG. 6. Spur S' of FIG. 4 is similar to spur S of FIG. 2 in that shank 15, towel 16 and band 25 may be the same, while each arm 27' is similar to arm 27, except that boss 28 and slot 29 are omitted. Button 22 is pivotally supported in an oblique recess 40 near the front end of each arm 27 and in the lower portion of the recess is installed a pivot pin 41 which is engaged by a pivot strip 42 which is doubled around pin 41 as a loop of FIG. 5. Button stem 23 may be attached to the outer ends of strip 42, as by riveting. Button 22 and strip 42 may be pivoted between an upper position shown in full lines in FIG. 4 to a lower position shown in dotted lines therein. The purpose of the lower position of the button is to more readily enable the spur S' and the tiedown strap T to be removed from the boot, without detachment from the alternative spur S', as pointed out later.

The alternative spur strap A of FIG. 6 is formed of the same or similar material as tiedown strap T. Strap A includes a central bar 45 provided at each end with an enlarged extension 46 having a hole 47 therein. Each extension 46 is stretchable to permit hole 47 to become elongated and to be inserted over a button 22, preferably after attachment of tiedown strap T thereto. Spur strap A is not only flexible but it is also stretchable, so that each extension 46 may be stretched for placement on a button B and also the entire strap may be stretched for attachment to both buttons, but when released, exerts a pull between the buttons and a detachable buckle, such as buckle 32 of spur strap 30, is unnecessary. Thus, for removal of the spur, only one end of strap A need be removed from a button 22, after which the buttons can be pivoted downwardly to the dotted position of FIG. 4, to enable loop 12 to be pulled downwardly off the boot heel and the spur, with strap A and tiedown T still attached to it, removed rearwardly from the boot. The spur may be reinstalled on the boot by placing the spur in position, with buttons 22 in the lower or dotted position of FIG. 4. Then, loop 12 may be stretched onto the front of the heel 18 and buttons 22 shifted to the upper or full line position of FIG. 4. Strap A, being attached to one button, may be pulled to hold the button up and extension 46 at the opposite end stretched to permit hole 47 to be slipped over the corresponding button, to complete the installation.

Although a preferred embodiment of this invention and certain variations have been illustrated and described, it will be understood that other embodiments may exist and that various changes may be made, all without departing from the spirit and scope of this invention.

What is claimed is:

1. A tiedown strap for a spur having a band, a shank extending rearwardly from said band and a rowel mounted on said shank, said band having arms extending forwardly alongside a counter of a boot having a sole and a heel below said counter, said tiedown strap comprising:

a body having a rear extension detachably connectable to the rear of said spur;

a front loop stretchable onto the front of said boot heel; and means at each side detachably connectable to the respective arms of said spur.

2. A tiedown strap as defined in claim 1, wherein:

said rear extension is stretchable and provided with a slot for engaging said spur shank.

3. A tiedown strap as defined in claim 1, for a spur provided with a button at each side on the respective arm, and wherein:

said detachably connectable means at each side comprises a stretchable extension at each side provided with a hole for slipping over the respective button of said spur.

4. A tiedown strap as defined in claim 1, for a spur provided with a button at each side of the respective arm and wherein:

said rear extension is stretchable and provided with a slot for engaging said spur shank; and said detachably connectable means at each side comprises a stretchable extension at each side provided with a hole for slipping over the respective button of said spur.

5. A tiedown strap as defined in claim 1, wherein:

said strap is molded from material having flexibility, stretchability and resistance to fatigue stress.

6. A tiedown strap as defined in claim 5, wherein:

said strap is neoprene.

7. A tiedown strap, as defined in claim 1, for a spur having a pivoted button at each side, wherein:

said detachably connectable means at each side comprises stretchable means for detachable connection to the respective button.

8. A tiedown strap as defined in claim 7, wherein:

said stretchable means comprises a stretchable extension at each side provided with a hole for slipping over the respective button of said spur.

9. The combination of a tiedown strap and a spur strap, for a spur having a band, a shank extending rearwardly from said band and a rowel mounted on said shank, said band having arms extending forwardly alongside a counter of a boot having a sole and a heel below said counter, said tiedown strap comprising:

a body having a rear extension detachably connectable to the rear of said spur;

a front loop stretchable onto the front of said boot heel; and means at each side detachably connectable to the respective arms of said spur; and said spur strap comprising:

a flexible bar stretchable across the instep of said boot and having means at each end for detachable connection to each arm of said spur.

10. The combination defined in claim 9, for a spur having a button on each arm adjacent the front end thereof, wherein:

said rear extension of said tiedown strap is stretchable and provided with a slot for engaging the shank of said spur;

said detachably connectable means at each side of said tiedown strap comprises a stretchable extension at each side provided with a hole for slipping over the respective button of said spur; and said spur strap has a central bar and said detachable connection means at each end thereof comprises an enlarged, stretchable extension at each end of said bar provided with a hole for slippinto onto the respective button.

11. The combination defined in claim 10, wherein:

each said spur button is pivotally mounted on said arm of said spur for movement between an upper position and a lower position.

* * * * *